United States Patent [19]

Chang

[11] Patent Number: 4,996,732

[45] Date of Patent: Mar. 5, 1991

[54] INNOVATED MECHANISM OF NON-ELECTRICAL FLEXIBLE CRADEL

[76] Inventor: Shyr-Shy Chang, 4F, NO.82, Cherng Gong Road, Section 2, Yung Ho City, Taipei, Taiwan

[21] Appl. No.: 478,223

[22] Filed: Feb. 9, 1990

[51] Int. Cl.[5] ..... A47D 9/00

[52] U.S. Cl. ..... 5/101; 5/130

[58] Field of Search ..... 5/102, 104, 98 R, 101, 5/120, 122, 123, 127, 130

[56] References Cited

U.S. PATENT DOCUMENTS

| | | | |
|---|---|---|---|
| 237,820 | 2/1881 | Clark | 5/102 |
| 250,119 | 11/1881 | Wilbur et al. | 5/102 |
| 582,215 | 5/1897 | Martin | 5/104 X |
| 630,851 | 8/1899 | Brass . | |
| 751,125 | 2/1904 | Wertz et al. | 5/102 X |
| 1,198,130 | 9/1916 | Hutchings | 5/104 |
| 1,204,416 | 11/1916 | Doser | 5/104 X |
| 1,372,219 | 3/1921 | Dieckmann | 5/104 X |
| 1,436,834 | 11/1922 | Van Atti | 5/104 X |
| 1,463,571 | 7/1923 | Brame | 5/104 X |
| 1,932,959 | 10/1933 | Denman | 5/130 |
| 2,467,890 | 4/1949 | Harvey | 5/98 R X |
| 3,203,012 | 8/1965 | Roberts | 5/104 X |
| 4,951,332 | 8/1990 | Barmettler | 5/127 |

*Primary Examiner*—Gary L. Smith
*Assistant Examiner*—Michael J. Milano
*Attorney, Agent, or Firm*—Notaro & Michalos

[57] ABSTRACT

A non-electrical cradle features flexible springs, stands and a U-shaped bag so that even a slight motion of a baby in the bag will produce swinging motion to give the baby a feeling of being huddled. Two mobile A-stands are connected by a connecting rod and support swing rods, the springs and the bag. The connecting rod penetrates top holes of the A-stands and is fixed in each hole by a bolt. At an appropriate location, a cross piece on each A-stand carries a bolt to support the swing rod at a bearing at the center on each cross piece, to enable left and right swinging of the swing rods. Each spring has a hook engaged in grooves on two sides of the swinging rod. At the four corners of the bag are belts which penetrate holes at two sides of strips at the ends of the bag, for engaging free ends of the springs.

5 Claims, 3 Drawing Sheets

INNOVATED MECHANISM OF NON-ELECTRICAL FLEXIBLE CRADEL

FIELD AND BACKGROUND OF THE INVENTION

This invention relates to a non-electrical cradle comprising two mobile "A" stands, a connecting rod, springs, strips and a U-shaped bag for receiving a baby. By suspending the bag from the A-stands and springs a flexible swinging motion with result when the baby moves, so that it can enjoy a sense of security and comfort as if huddled by its mother, and that it can enjoy relaxed and comfortable sleep, so that the adult can save some babysitting time to attend household chores. It is indeed a very practical, creative and excellent invention.

The cradle has been used by human beings from ancient times and includes the use of ropes and strings with an arched stand for swinging to modern sound-controlled cradles. Swinging motion by means of suspended ropes or arched stands must be activated by human labor, so that people must spend much time pushing the cradle and waiting until the baby is put to sleep. Therefore, putting a baby to sleep has been a major and troublesome task. So in this day of advanced scientific technology, someone has employed electronic parts and components to assemble a sound-controlled cradle, so the baby's crying sound will activate the required swinging motion. Though it has solved the problem of human labor to push the cradle, its effects are not so perfect. Because it has to rely on the baby's crying to activate the swinging mechanism, so the baby has to cry out loud to start the swinging motion. Furthermore, its swinging direction is different from that when a baby is huddled by an adult. Though such sound-controlled cradle can alleviate the trouble in conventional ways of huddling a baby to sleep, its swinging direction and the shape of the bag accommodating the baby are inadequate in giving the baby the feeling of being huddled by its mother. Also, the sound-control device is an electrical appliance and its safety is worth considering.

SUMMARY OF THE INVENTION

This invention relates to a type of non-electrical cradle featuring flexible springs, an A-stand and U-shaped bags so that even a slight motion of the baby in the bag will produce swinging motion to give the baby a feeling of being huddled. It comprises two mobile A-stands, a connecting rod, swing rods, springs, strips and the bag. The connecting rod is inserted into a top hole of the A-stand and tightened by a bolt. At an appropriate location on a cross piece of the A-stand, a tightening bolt is used to fix each swing rod which bears at the center on the cross piece, to enable left and right swinging of the swing rod. A hook of each spring is engaged in grooves at opposite ends of the swing rod and at the four corners of the bag. Belts at the corners of the bag penetrate holes at two ends of strips at the ends of the bag and catch onto the springs.

BRIEF DESCRIPTION OF THE DRAWINGS

FIG. 3-1 is a view similar to FIG. 3 with the moving rod collapsed.

DETAILED DESCRIPTION OF THE PREFERRED EMBODIMENT

Figure 1:
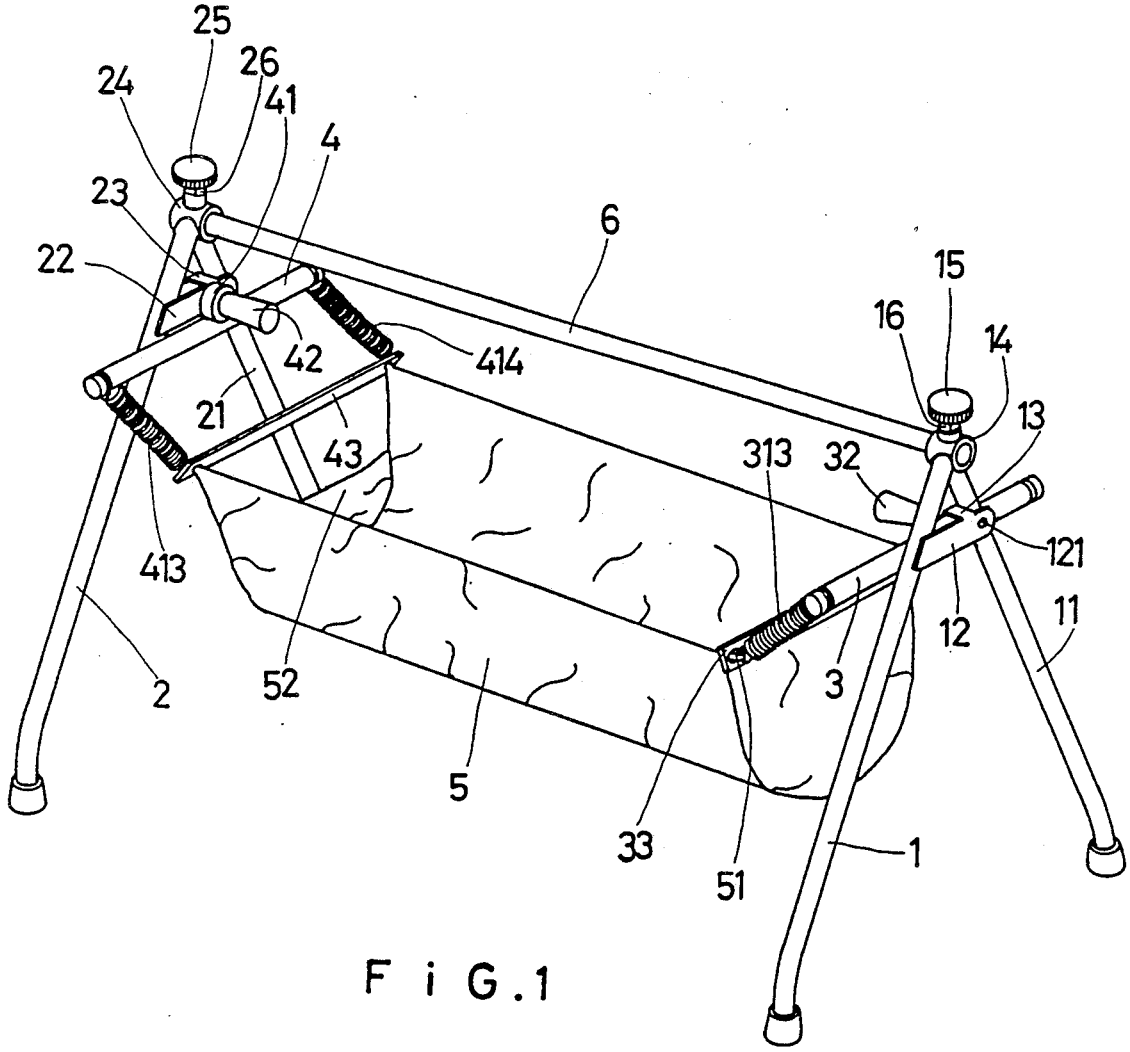
FIG. 1 is a perspective view of the subject invention.
Figure 2:
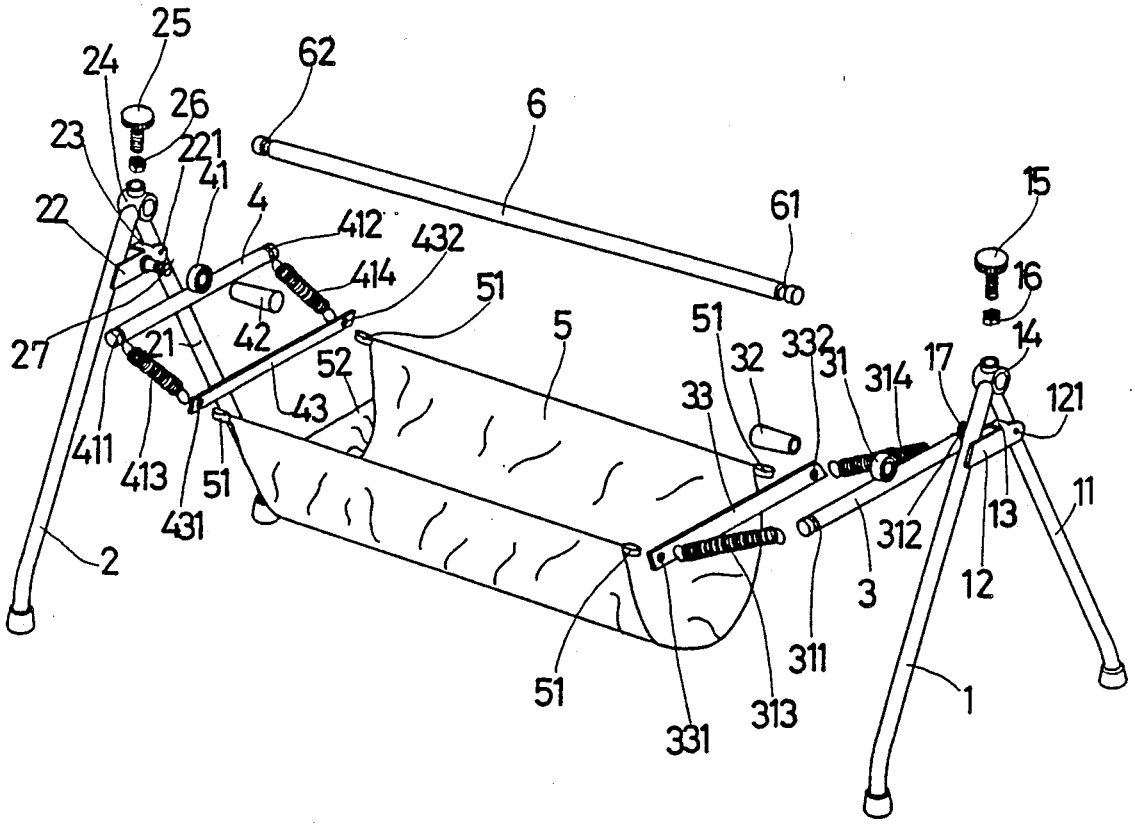
FIG. 2 is a perspective exploded view of the subject invention.
Figure 3:
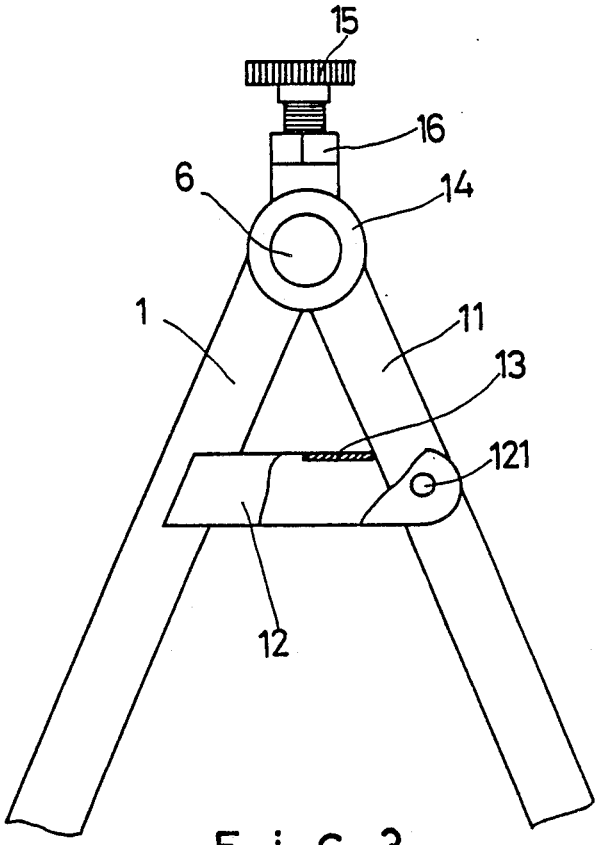
FIG. 3 is a partial side view of the A-stand showing the relationship between the mobile and fixed rods thereof.
Figures 1, 3:
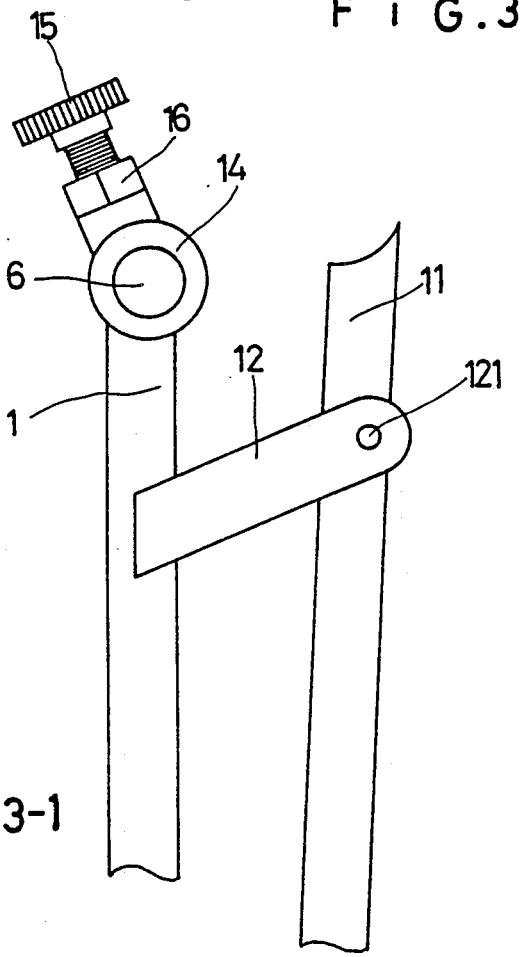

Referring to FIG. 1 and FIG. 2, the invention comprises two A-stands which are each formed by fixing rods 1 and 2, on one side, and mobile rods 11 and 21 on an opposite side of the cradle. A cross piece 12, 22 is pivotally connected to each mobile rod 11, 21, at a pivot connection 121, 221, so that each mobile rod 11, 21 can pivot with respect to its cross piece 12, 22 as shown in FIG. 3-1. The opposite end of each cross piece 12, 22 is fixed to one of the fixing rods 1, 2. A catch or stop tab 13, 23 extends from the upper edge of each cross piece 12, 21 and engages the inner surface of mobile rod 11, 21 to brace the rod in the position of FIG. 3. Each mobile rod 11, 21 also includes a curved upper end which rest against the outer contour of a sleeve 14, 24 which is fixed to the upper end of each fixing rod 1, 2.

Figure 4:
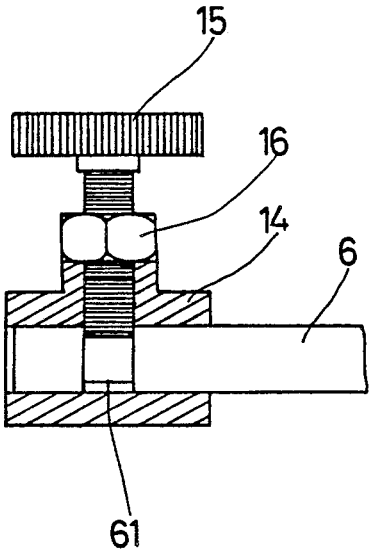
FIG. 4 is a sectional view showing the relationship between the connecting rod and bolt of the cradle.

Each sleeve 14 includes a hole therethrough for receiving one end of a connecting rod 6 which connects the A-stands to each other. Connecting rod 6 includes grooves 61 and 62 at opposite ends of the rod which are each engagable by a bolt 15 and 25 which is threadable into respective sleeves 14 and 24, and locked in place by lock nuts 16 and 26 respectively as shown in FIG. 4.

Each cross piece 12, 22 has an inwardly extending bolt 17, 27 as shown in FIG. 2, which receives a bushing 31, 41 fixed to respective swing rods 3, 4. Each bushing 31, 41 is hermetically engaged with a respective bolt 17, 27 so that the swing rods 3, 4 can pivot about the bolts without making any noise. Each bushing 31, 41 is held to its bolt 17, 27 by a handle 32, 42 which is threaded onto the bolts 17, 27.

Two springs 313 and 314 have respective hooks which are engaged within circular grooves 311 and 312 on opposite ends of the swing rod 3. In likewise fashion, springs 413 and 414 have loops engaged within the circular grooves 411 and 412 at the opposite ends of swing rod 4.

Each spring 313, 314, 413 and 414, has a lower loop which engages belts 51 at the four upper corners of a U-shaped bag 5, each belt extending through a hole 331, 332, 431 and 432 at the opposite ends of a pair of support strips 33 and 43, at the opposite ends of the bag 5.

One end of the U-shaped bag 5 is closed by a stop cloth or web 52 which prevents cold air from flowing directly to the baby's head when the baby is cradled within the U-shaped bag 5.

Motion of the bag 5 is produced by any movement of the baby within the bag, by virtue of the flexible springs 313, 314, 413 and 414. Additional swinging can be produced by rotation of the swing rods 3, 4 on their respective bolts 17, 27.

I claim:

1. A motion activated self-rocking cradle, comprising:

a U-shaped bag having four corners and shaped for receiving a baby;

a belt at each corner of said bag;

a strip at each end of said bag, each strip having opposite holes, each hole and each strip receiving one of said belts;

a spring for each belt, each spring having a lower loop engaged with a respective belt, and an upper loop;

a swing rod at each end of said bag, two of said springs at each end of said bag being connected to respective opposite ends of each swing rod;

a bushing fixed near the center of each swing rod;

an A-stand at each end of said bag, each A-stand comprising a fixed rod, a sleeve connected to an upper end of said fixed rod, said sleeve having a hole therethrough, a mobile rod engagable against said sleeve and a cross piece fixed to said fixed rod and pivotally connected to said mobile rod for holding said mobile rod in a selected orientation with respect to said fixed rod, said bushing of each swing rod being operatively connected to one of said cross pieces;

a connecting rod having opposite ends each extending into the hole of one sleeve for connecting said A-stands to each other; and fixing means for fixing each end of said connecting rod to one of said sleeves.

2. A cradle according to claim 1, wherein said fixing means comprises a groove at each end of said connecting and a bolt threaded to each sleeve and engagable into one of said grooves.

3. A cradle according to claim 2, wherein each swing rod has opposite ends with grooves therein, the upper loop of each spring being engaged with one of said grooves of said swing rod.

4. A cradle according to claim 3 including a further bolt connected to each cross piece and extending toward said bag, one of said bushings being engaged with each bolt of a respective cross piece, and a handle threaded to each bolt of each cross piece for retaining each bushing.

5. A cradle according to claim 4 including a tab on each cross piece engaged with a respective mobile rod for bracing each mobile rod.

* * * * *